US012139924B1

(12) United States Patent
Beam

(10) Patent No.: US 12,139,924 B1
(45) Date of Patent: Nov. 12, 2024

(54) SUN SHADE

(71) Applicant: Kelly Beam, Charleston, SC (US)

(72) Inventor: Kelly Beam, Charleston, SC (US)

( * ) Notice: Subject to any disclaimer, the term of this patent is extended or adjusted under 35 U.S.C. 154(b) by 181 days.

(21) Appl. No.: 17/870,905

(22) Filed: Jul. 22, 2022

Related U.S. Application Data

(60) Provisional application No. 63/226,038, filed on Jul. 27, 2021.

(51) Int. Cl.

| | |
|---|---|
| ***E04H 15/40*** | (2006.01) |
| ***A47C 7/66*** | (2006.01) |
| ***A47C 29/00*** | (2006.01) |
| ***A47G 9/10*** | (2006.01) |
| ***E04H 15/02*** | (2006.01) |
| ***E04H 15/36*** | (2006.01) |
| ***E04H 15/44*** | (2006.01) |
| ***E04H 15/56*** | (2006.01) |

(52) U.S. Cl.
CPC ..... *E04H 15/40* (2013.01); *A47C 7/66* (2013.01); *A47C 29/003* (2013.01); *A47G 9/1045* (2013.01); *E04H 15/02* (2013.01); *E04H 15/36* (2013.01); *E04H 15/44* (2013.01); *E04H 15/56* (2013.01)

(58) Field of Classification Search
CPC ..... A47C 9/1045; A47C 7/66; A47C 29/003; B62B 9/142; B62B 9/147; B60J 7/10; E04H 15/40; E04H 15/02; E04H 15/36; E04H 15/44; E04H 15/56; A45B 2020/0006
USPC ..... 135/96, 124, 125, 128, 136, 137, 138, 135/116, 87; 297/184.1, 184.11, 184.12, 297/184.15, 184.17; 5/121, 414, 418
See application file for complete search history.

(56) References Cited

U.S. PATENT DOCUMENTS

| | | | | | |
|---|---|---|---|---|---|
| 84,381 | A * | 11/1868 | Seaman | A47C 29/006 | 135/913 |
| 1,746,833 | A * | 2/1930 | Hermansen | B63C 9/1255 | 5/418 |
| 2,055,044 | A * | 9/1936 | Nelson | E04H 15/324 | 5/413 R |
| 2,357,056 | A * | 8/1944 | Nelson | A47C 29/006 | 135/96 |
| 2,565,746 | A * | 8/1951 | Turner | B60J 7/102 | 135/137 |
| 2,771,125 | A * | 11/1956 | Dobbins | E04H 15/003 | 5/418 |
| 2,932,833 | A * | 4/1960 | Wambach | A47G 9/1045 | 5/418 |
| 2,942,914 | A * | 6/1960 | Noot | B62B 3/007 | 280/87.01 |
| 3,241,160 | A * | 3/1966 | Pablo | A47C 7/666 | 5/643 |
| 3,651,847 | A | 3/1972 | Casamassima | | |
| 3,703,181 | A * | 11/1972 | Tholen | E04H 15/06 | 135/904 |

(Continued)

*Primary Examiner* — Robert Canfield
(74) *Attorney, Agent, or Firm* — Bill Killough

(57) ABSTRACT

A sun shade blocks or inhibits ultraviolet radiation emitted by the sun from reaching the head of a user. Positioning of supporting stations of the sun shade relative to a base is adjustable so that shading provided by a canopy of the sun shade can be user selected. Positioning of the canopy along the stanchions may also be adjustable. The sun shade is usable as a stand alone device, or it may be attached to other devices such as beach chairs or lounge chairs.

13 Claims, 11 Drawing Sheets

(56) References Cited

U.S. PATENT DOCUMENTS 3,812,616 A * 5/1974 Koziol ..... A01G 9/16 47/29.1
4,063,318 A 12/1977 Nicholson
4,082,102 A 4/1978 Heuer
4,091,584 A * 5/1978 Brown ..... E04H 15/40 52/63
4,100,633 A 7/1978 Pintos
4,152,792 A * 5/1979 Glintz ..... A61G 7/0005 4/452
4,379,349 A 4/1983 Larson
4,425,675 A 1/1984 Victor
4,471,793 A * 9/1984 Cattaneo ..... B60P 3/38 135/904
4,639,958 A 2/1987 Lerner
4,796,734 A 1/1989 Distasio
4,830,036 A * 5/1989 Sanders ..... E04H 15/06 135/132
4,978,166 A * 12/1990 James ..... A47D 15/00 297/400
5,033,528 A 7/1991 Volcani
5,116,288 A 5/1992 Kondo et al.
5,313,666 A * 5/1994 Bax ..... E04H 15/003 2/9
5,320,405 A * 6/1994 Foster ..... A47C 7/66 5/418
5,515,564 A * 5/1996 Lyons ..... A47C 1/14 5/639
5,551,110 A 9/1996 Armstrong et al.
5,609,177 A * 3/1997 Iver ..... E04H 15/003 135/133
5,690,133 A * 11/1997 Capwell ..... B63B 17/02 135/96
D388,473 S * 12/1997 Pasin ..... D12/129
5,823,217 A * 10/1998 Rice ..... E04H 15/40 135/900
6,085,768 A * 7/2000 Arlotta ..... A45B 23/00 135/124
6,173,725 B1 1/2001 Garth
6,330,889 B1 12/2001 Overton
6,402,220 B2 * 6/2002 Allen ..... B62J 19/00 135/124
6,405,742 B1 6/2002 Driscoll
6,454,340 B1 * 9/2002 Miller ..... B60J 7/10 296/105
6,644,329 B2 * 11/2003 Tomason ..... E04H 15/02 135/96
6,668,407 B1 12/2003 Reitzel
6,711,769 B1 * 3/2004 Jane-Prats ..... A45B 23/00 5/639
D544,062 S * 6/2007 Baker ..... D21/837
D551,724 S * 9/2007 Seckel ..... D21/536
7,347,217 B2 3/2008 Bree et al.
7,376,993 B2 * 5/2008 Myers ..... A47D 13/066
D574,918 S * 8/2008 McAlister ..... D21/834
D602,707 S * 10/2009 VanElverdinghe ..... D6/389
8,453,664 B2 * 6/2013 Parsons ..... E04H 15/003 135/137
9,016,300 B1 4/2015 Gillespie
9,103,137 B2 * 8/2015 Williams ..... E04H 15/40
9,175,496 B2 11/2015 Darquea et al.
9,232,836 B1 1/2016 Zaccaro et al.
9,874,038 B2 1/2018 Pashandi
10,058,186 B2 8/2018 Rivera
10,612,267 B2 4/2020 Nelson
11,053,706 B2 * 7/2021 Knapp ..... B60H 1/3226
D960,277 S * 8/2022 Lah ..... D21/837
2003/0145378 A1 * 8/2003 Williams ..... A47C 29/006 135/96
2005/0109383 A1 5/2005 Pham
2007/0028358 A1 * 2/2007 Baek ..... E04H 15/40 2/171
2008/0142062 A1 6/2008 Carrieri
2011/0108078 A1 * 5/2011 Roman ..... E04H 15/64 135/121
2013/0125942 A1 * 5/2013 Stoll ..... E04F 10/00 135/16
2020/0318378 A1 * 10/2020 Furuland ..... E04H 15/56
2023/0183998 A1 * 6/2023 Fujii ..... E04H 15/36 135/87

* cited by examiner

SUN SHADE

SUMMARY OF THE INVENTION

The present invention is a sun shade. The sun shade is constructed to block or inhibit ultraviolet radiation from the sun from reaching the head of a user. Positioning of supporting stations of the sun shade relative to a base is adjustable so that shading provided by a canopy of the sun shade can be user selected. Positioning of the canopy along the stanchions may also be adjustable. The sun shade is usable as a stand-alone device, or it may be attached to other devices such as beach chairs or lounge chairs.

DESCRIPTION OF PREFERRED EMBODIMENTS

Figure 1:
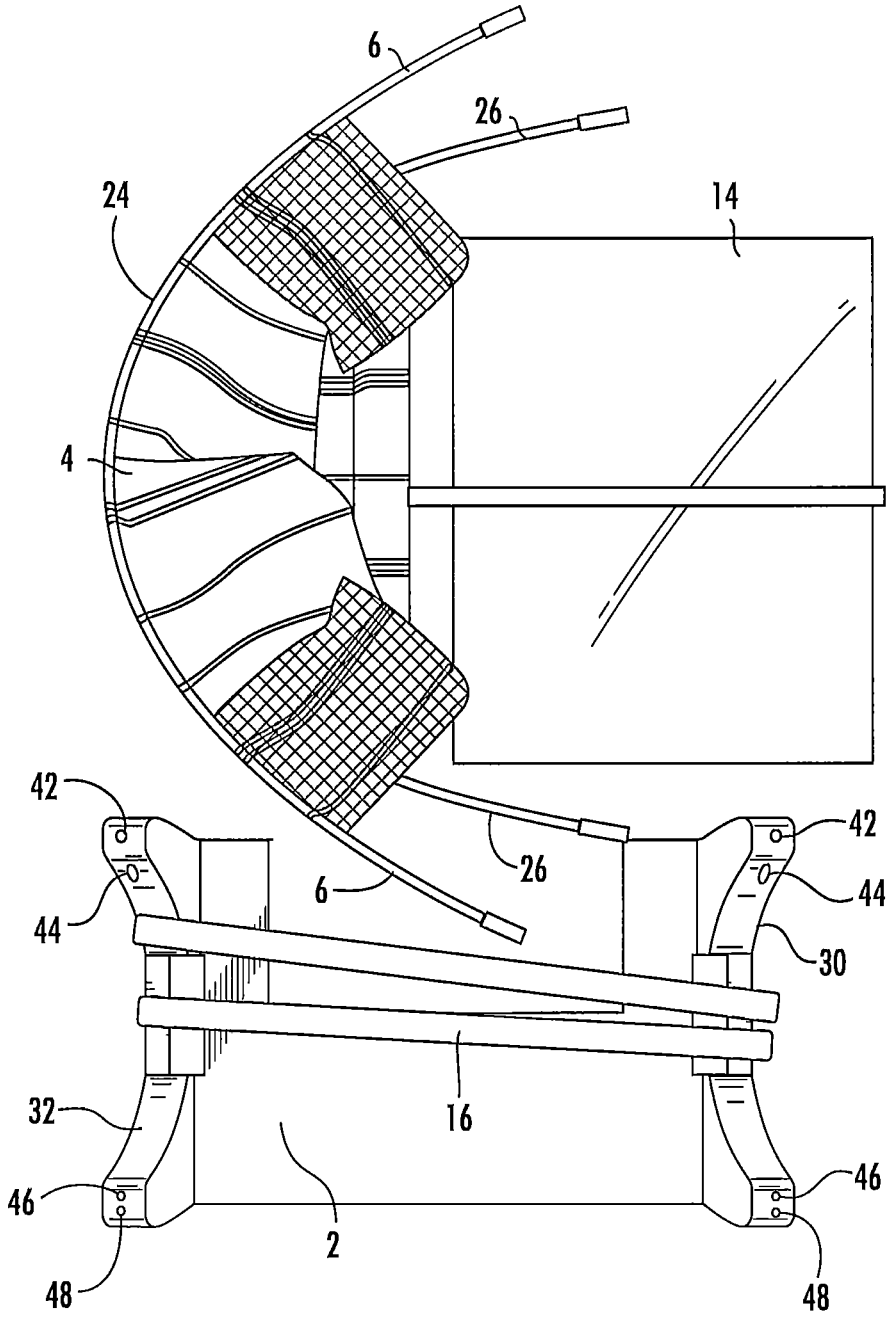
FIG. 1 shows elements of the sun shade according to an embodiment of the invention.
Figure 8:
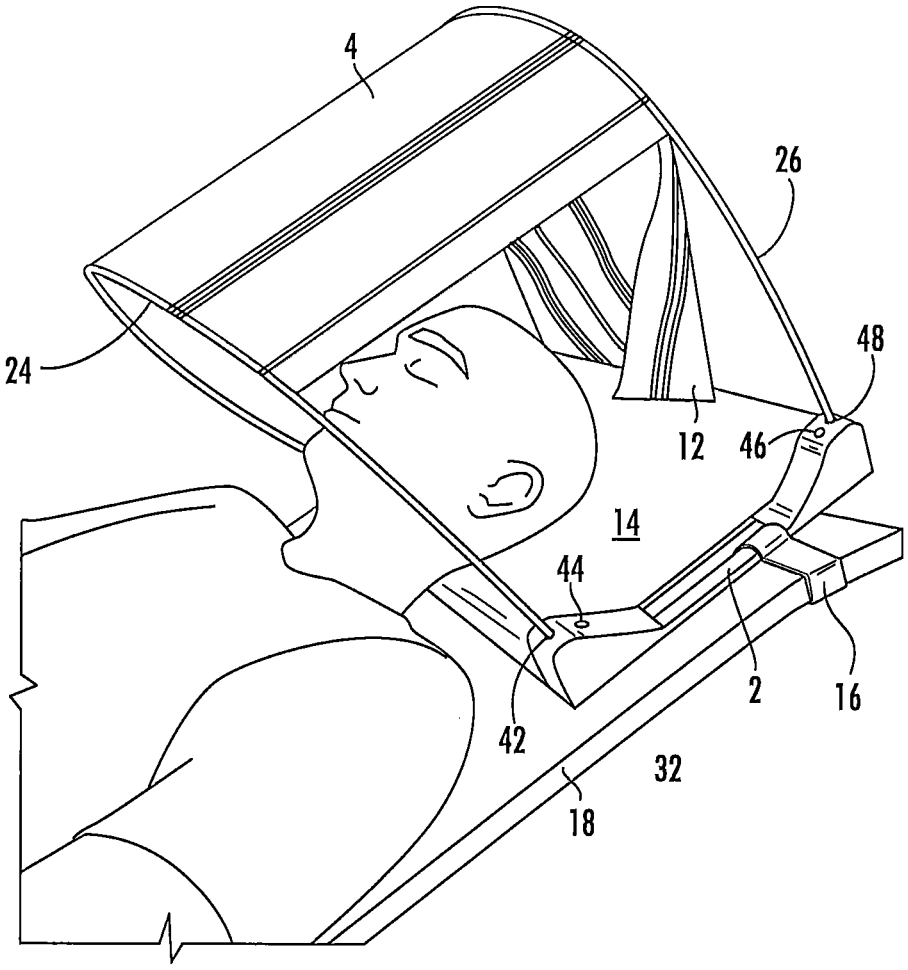
FIG. 8 is a perspective view of the sun shade mounted to a chair and the canopy opened on one side of the sun shade.

An embodiment of the sun shade, as shown in FIG. 1, provides a base 2. A canopy 4 is provided that is supported by arcuate stanchions 6,26. The canopy is slidable along the arcuate stanchions for adjusting the position of the canopy to open and close portions of the canopy. FIG. 8. Channels 24 may be formed in the canopy near a front and a rear of the canopy through which the arcuate stanchion are positioned, and which facilitate sliding of the canopy along the stanchions. The canopy may also comprise a back panel 12 in addition to a top enclosure. A pillow or cushion 14 may overlay the base of the sun shade.

Figure 2:
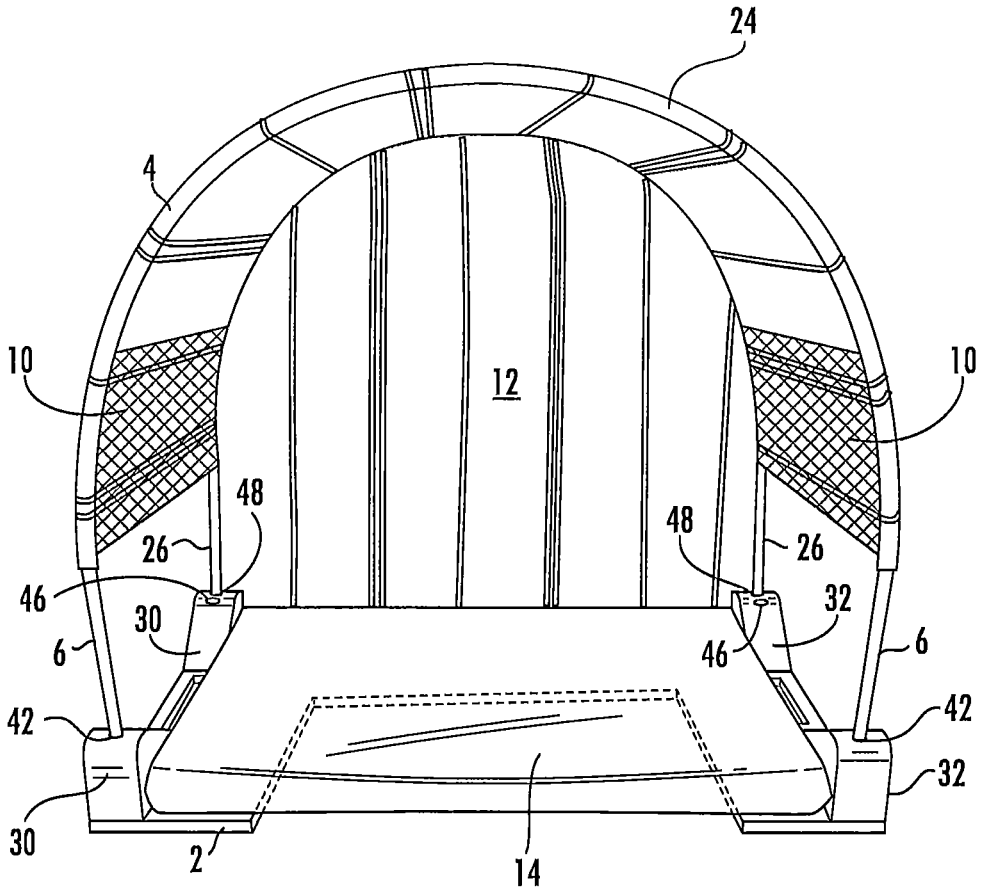
FIG. 2 is front, perspective view of the assembled sun shade.

FIG. 2 shows an embodiment of the assembled sun shade. The arcuate stanchions 6 are positioned within receptacles 8 that are formed in a first rib 30 and a second rib 32 that are generally parallel to each other, and extend upwardly from the base 2 at the front and rear of the base in this embodiment. The canopy 4 is mounted to the arcuate stanchions to form a tent like structure with a top covering and optionally, a back panel 12. The pillow 14 may be positioned over the base between the stanchions that are present on opposite sides of the base. In this embodiment, two arcuate stanchions are used. One stanchion is positioned in the receptacle apertures 42,44 at a front of the canopy and the other stanchion is positioned in the one of the receptable apertures 46,48 at a rear of the canopy when the canopy is positioned as shown in FIG. 2. A first end of one of the two stanchions 6,26 is positioned in a receptacle aperture that is formed in a rib 30 extending from one side of the base and the opposite end of the stanchion is positioned in a receptacle aperture that is formed in a rib 32 that is present on the opposite side of the base. A first end of the other stanchion is positioned in a receptacle aperture that is formed in rib 30 on one side of the base and the opposite end of the other stanchion is positioned in a receptacle aperture that is formed in the rib 32 on the opposite side of the base.

Figure 3:
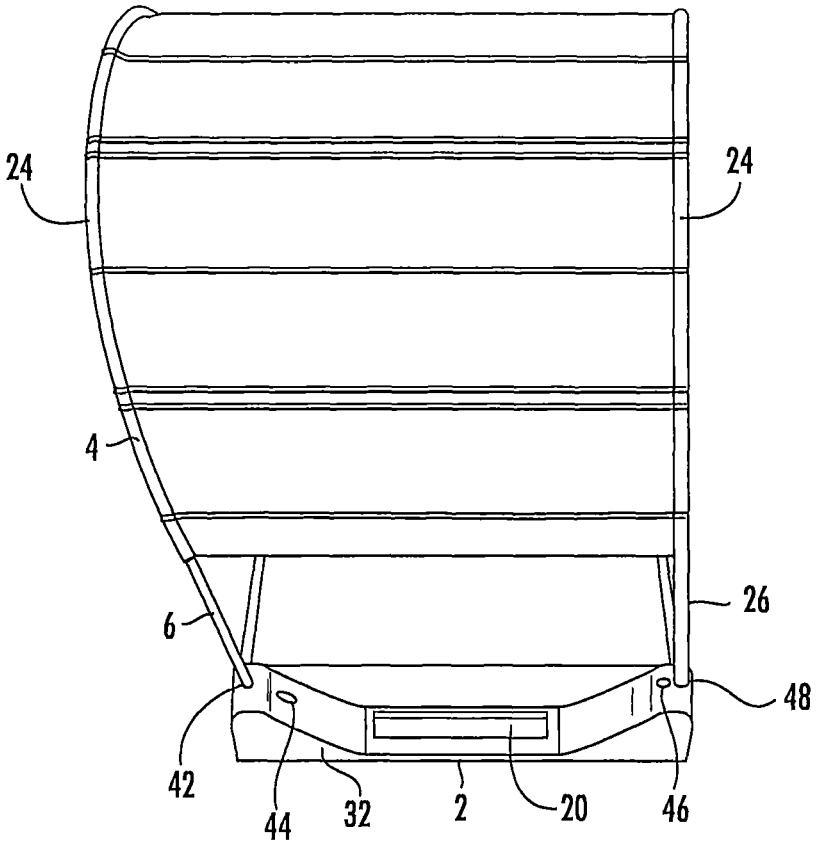
FIG. 3 is a side, perspective view of the assembled sun shade.

FIG. 3 shows a view taken from above and from a side of the sun shade. As shown in FIG. 3, the front stanchion 6 is angled away from the back stanchion. Receptacle apertures 42 are formed at an angle in ribs 30,32 so that the canopy that extends forward and past the front of the base 2 of the sun shade. This angle is preferred to be between twenty and forty degrees)(20°-40°) from a vertical positioning of the front stanchion. The inventor has discovered that even a relatively small angle that provides a longer canopy at the top can provide substantially greater shade coverage to the user's face as compared to a vertical mounting of the stanchions. At the same time, the user's useful view from within the sun shade is not materially inhibited by this angle. This is particularly true with some angles of the sun, or with angles of a back of a beach or lounge chair in combination with angles of the sun. FIG. 8 demonstrates the sun shade attached to a lounge chair 18, such as by straps 16, with stanchion 6 positioned in receptacle aperture 42 so that the stanchion 6 is angled forward, and toward the user's torso, and in this embodiment, beyond the base.

Receptacle apertures 44 are formed so that when these apertures are selected, stanchion 6 extends vertically from the ribs 30,32 of the base. Positioning of the arcuate stanchion 6 within the receptacle apertures, 42, 44 or 46, is user selectable, so that shading or coverage of the user by the canopy is variable.

Figure 4:
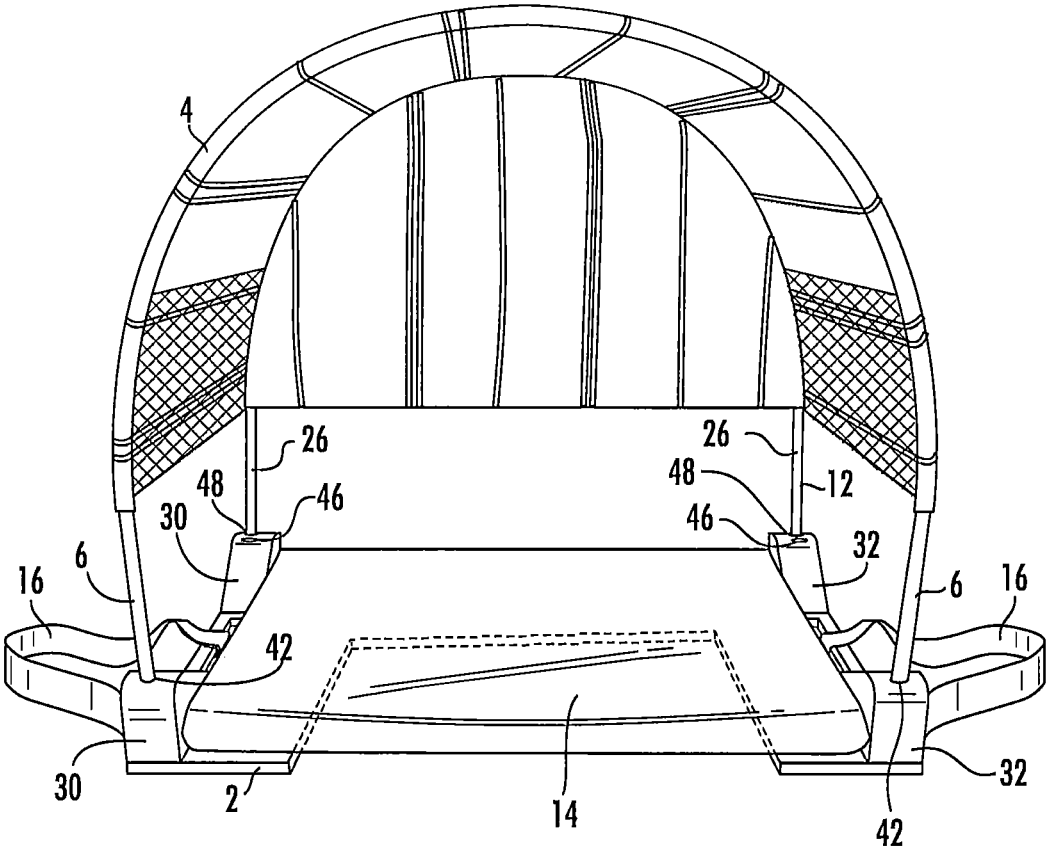
FIG. 4 is another front, perspective view of the assembled sun shade.

As shown in FIG. 8, the degree to which the sides of the canopy 4 occlude light is adjustable. The relative length of the sides of the canopy is adjusted by the sliding the channels 24 of the canopy along the arcuate stanchions 6, 26. One side or both sides may slide along the stanchions to adjust the length of the sides. The formation of the canopy of cloth or similar material means that the canopy material will fold against itself as it is pushed upwardly along the stanchions. The coverage of the canopy material may be selected when the canopy is produced. In the embodiments of FIG. 2 and FIG. 4, the canopy may be positioned by sliding along the arcuate stanchions so that one side is substantially fully occluded or blocked, while the other side is mostly open as shown in FIG. 8.

Figure 5:
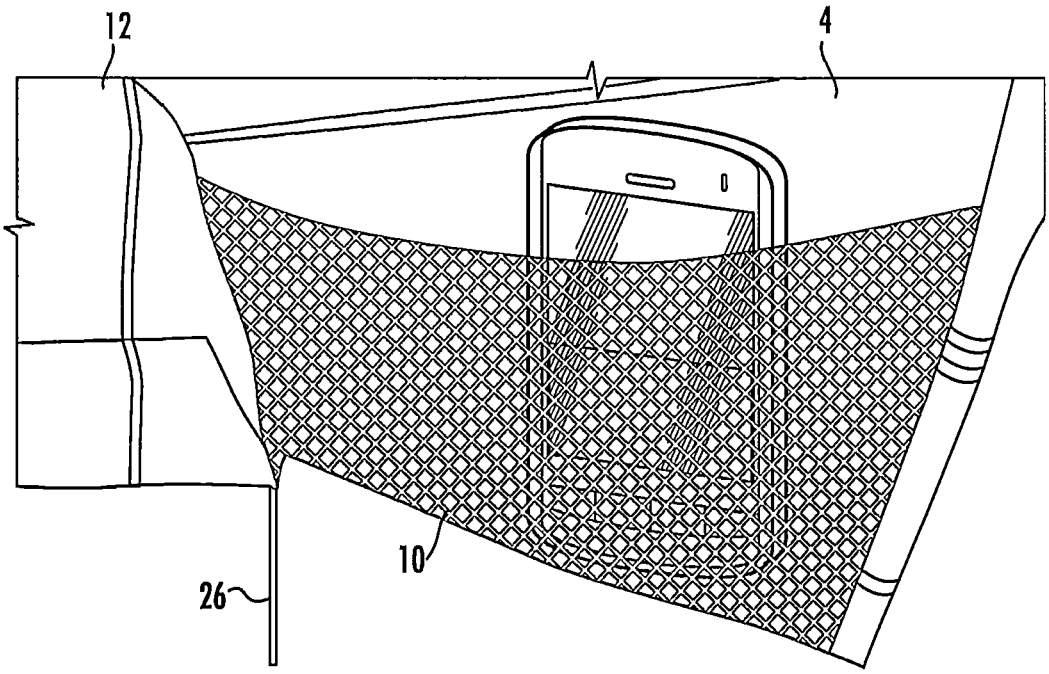
FIG. 5 is an isolation of an inside of a canopy of the sunshade demonstrating a pocket formed in the canopy.

The back panel 12 is affixed to a top portion of the sun shade. As shown in FIG. 5, the back panel of the sun shade can be rolled or folded up if full covering of the back panel from the top of the canopy to the base is not desired. The back panel can be held in an open or partially open position relative to the canopy by hook and loop material, snaps or strips of fabric, or other materials.

As shown in FIG. 2, pockets 10 may be provided on the interior of the canopy 4. The pockets may be formed of a mesh material that is attached to the canopy. Since the sun shade is useful at beaches, pools and the like while sun bathing, having pockets available on the interior of the sun shade is very handy. Attire worn in such settings does not typically lend itself to having pockets within clothing. By having the pockets on the interior of the sun shade, personal effects placed within the pockets are not publicly visible. FIG. 5 shows a close-up view of a pocket attached to one of the sides of the canopy.

Figure 6:
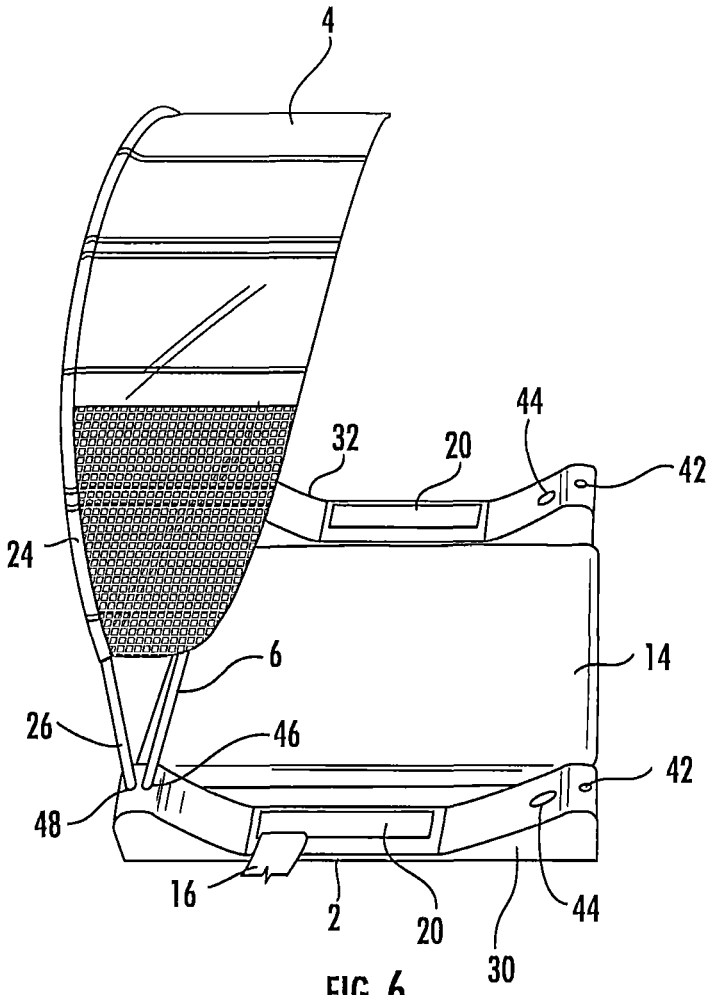
FIG. 6 is a side, perspective view of the assembled sun shade with the canopy repositioned from the view shown in FIG. 3.
Figure 9:
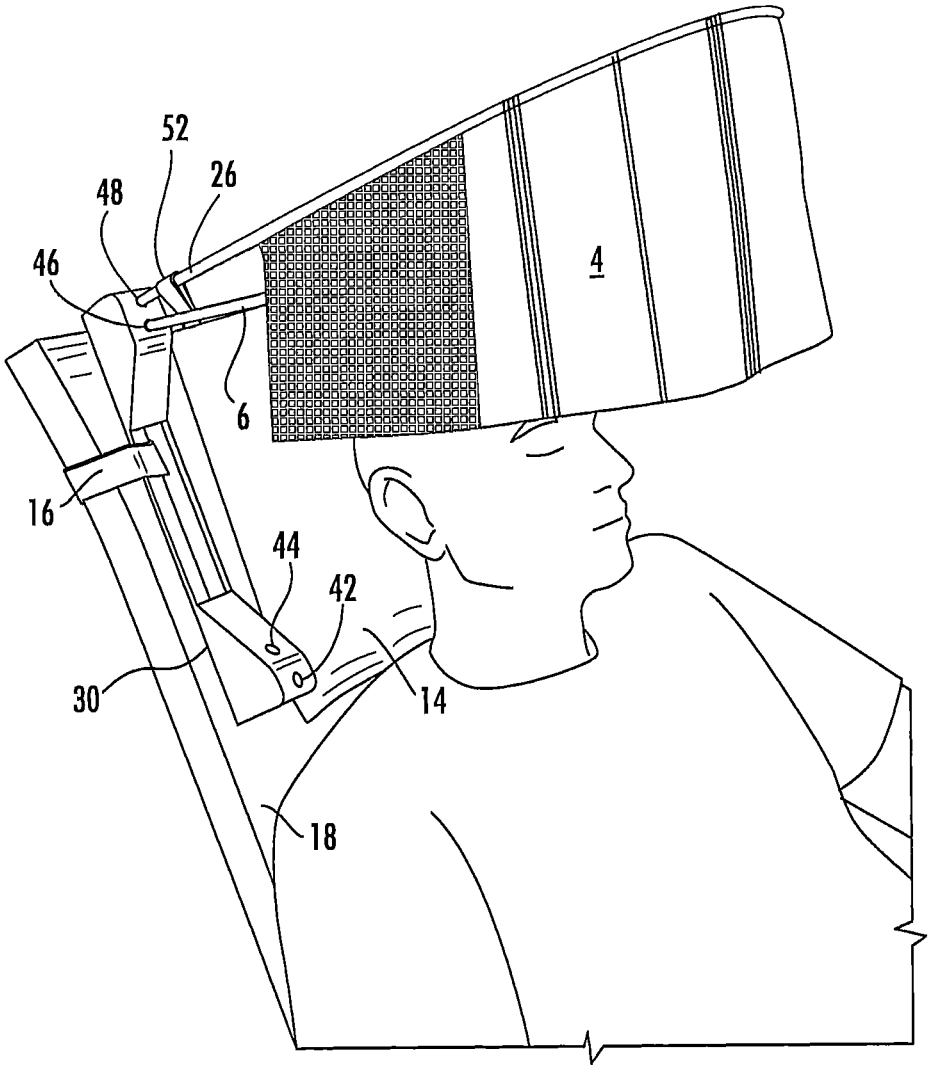
FIG. 9 is a perspective view of the sun shade mounted to a chair and the canopy positioned as shown in FIG. 6.

FIG. 6 shows that the front stanchion 6 may be removed from the receptacle apertures 42 or 44, and positioned rearwardly. Stanchion 6 is positioned in receptacle apertures 46 formed in ribs 30,32. Receptacle apertures 46 are formed at an angle in ribs 30,32 so that the stanchion extends forward, while receptacle apertures 48 are formed so that stanchion 26 has a vertical orientation. The angle of receptacle apertures 46 is preferred to be between ten and thirty degrees)(10°-30°) from a vertical positioning. Receptacle apertures 46 allow stanchion 6 to be positioned rearwardly, providing more exposure of the user's head and face, as shown in FIG. 9. When attached to a lounge chair 18 as shown, this position protects the user's head and perhaps neck from direct sunlight when, for example, the sun is substantially overhead. The user's view is not blocked by the sun shade, and substantial ventilation is available.

Additional receptacles of varying angles may be provided in the ribs 30,32 positioning of the stanchions 6,26 to provide additional user selectivity in positioning the canopy or rear stanchions in various places as desired by users. In yet another embodiment, the receptables are slidable along the base for movement of the stanchions to desired positions. The receptacles slide along the base, but may be locked in position as desired.

Figure 7:
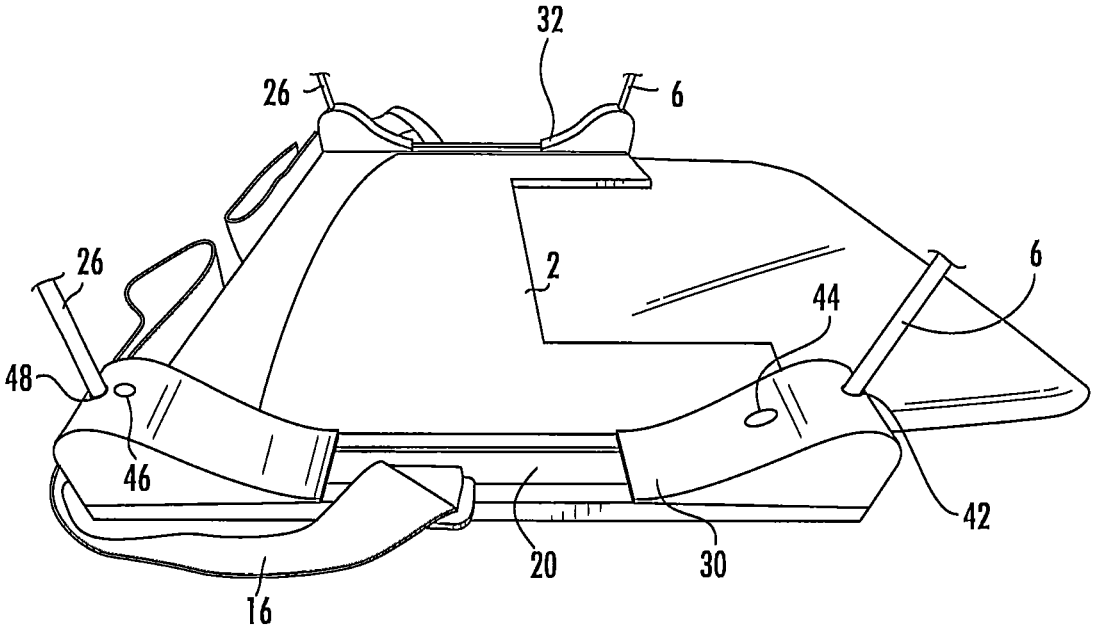
FIG. 7 shows the base for the sun shade in isolation, with stanchions mounted in receptacle apertures formed in the ribs of the base.
Figure 10:
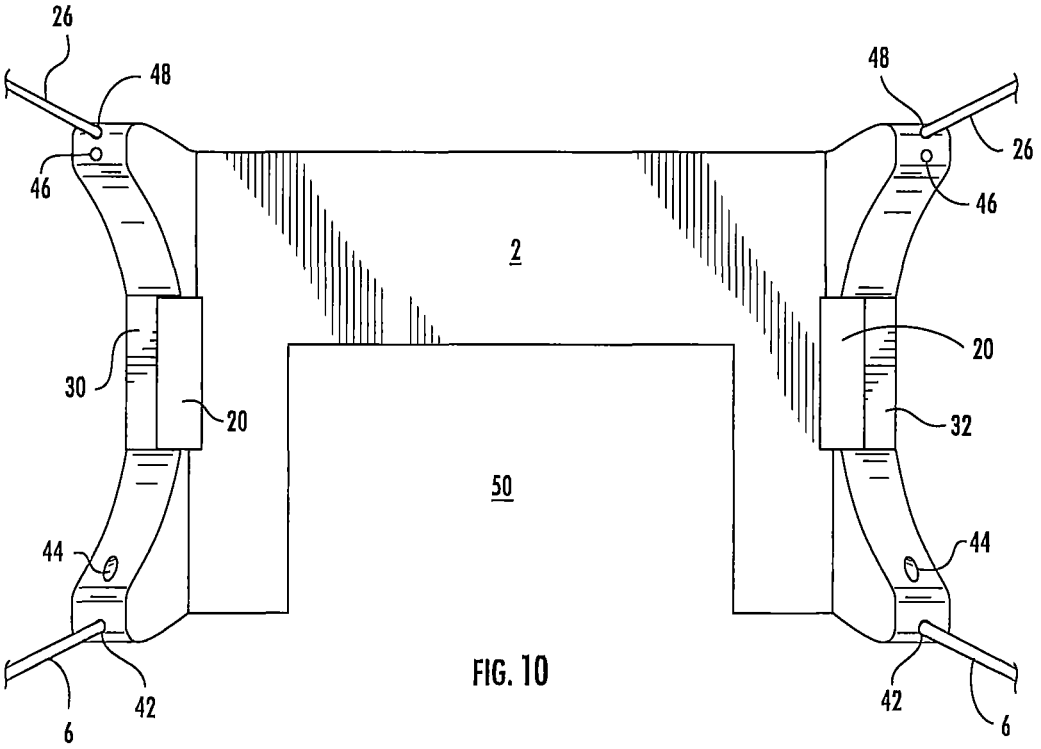
FIG. 10 is a top view of the base of the sun shade.

FIGS. 7 and 10 show the base 2 for the sun shade in isolation, with the stanchions 6,26 mounted in receptacles 42, 48. Straps 16 for mounting the sun shade to a beach chair, lounge chair 18 or other item may be connected to the base and the chair or other item as shown in the drawings. Hand holds 20 are provided for carrying the sun shade. The hand holds may be formed in the ribs 30,32 or the base 2 itself.

In a preferred embodiment, the base 2 is formed with ribs 30,32 present on opposite sides of the base. Each rib has two tumids or humps formed in the base, with one tumid present near each end of the rib. Each tumid may have an arcuate surface that reduces the size of the ribs near the center of the ribs. The hand holds 20 may be formed between the tumids of each rib, and at a portion of the ribs that is reduced in size from the tumids. Receptacle apertures 42, 44, 46 and 48 as described are formed in the tumids, as shown in the drawings.

FIG. 8 shows the sun shade in use and mounted to a lounge chair 18. In this embodiment, the position of the canopy 4 is changed by sliding the canopy along the arcuate stanchions 6. A side of the canopy has been positioned so that it is in the fully down position to block such on that side. In this embodiment, when positioned with one side fully down, the opposite side is partially open. A user may desire to have one side or other of the sun shade fully blocked when the angle of the sun is such that this position provides the most sun protection. However, the opposite side is partially open as shown in FIG. 8, which provides ventilation. Having one side open also allows the user to more easily communicate with people on the open side, and also provides visibility on that side.

The back panel 12 of the canopy 4 is prepared to be releasably attached to the base. Hook and loop material or another fastener such as snaps may be affixed to the rear of the base 2 and the back panel 12 of the canopy 4 to secure the back panel of the canopy in position. If ventilation is desired through the back panel, the back panel can be rolled or folded as shown in FIG. 5, or a portion of the back panel can be released so that the back panel does not attach as shown in FIG. 8.

Figure 11:
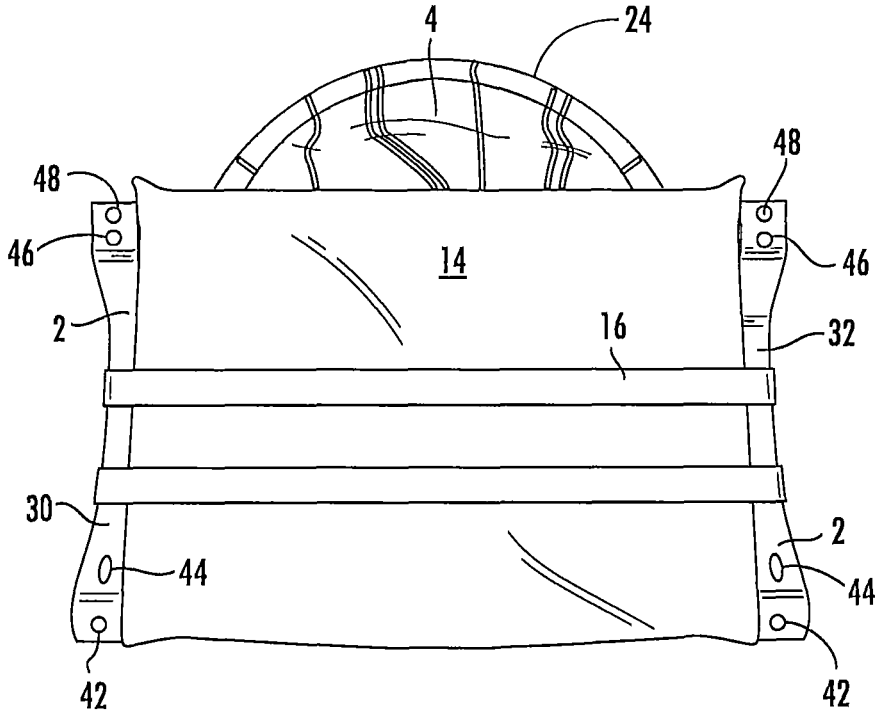
FIG. 11 shows a top plan view of the sun shade disassembled from its configuration in use and assembled for transport.

The sun shade may be disassembled, as shown in FIG. 11, and packed. The stanchions 6,26 are removed from the receptacle apertures. The stanchions and canopy 4 positioned horizontally over the base so that the assembly is generally flat. The pillow or cushion 14 is positioned over the canopy and stanchions to hold them in position and protect them. The mounting straps 16 hold the pillow and canopy construct in place. The tumids of the ribs 30, 32 assist in holding the pillow in position. The mounting straps are tightened against the elements of the sun shade for easy carrying and transport of the sun shade. The sun shade may be easily transported by grasping one or both of the hand holds 20.

The stanchions 6 are defined to be arcuate. The stanchions form an arc along their length as shown in the drawing figures, without having any sharp angles or other impediments along their length that would be likely to prevent easy sliding of the canopy 4. The accurate stanchions allow the canopy to slide along the stanchions to adjust the length of the sides of the canopy as desired. The stanchions are preferred to be made of a material so that they are flexible, so that they may be configured in various positions in the ribs 30,32 as described herein and packed as shown in FIG. 11. The stanchions are detachably positioned in the receptacle apertures 42,44,46,48 so that the stanchions are held within the receptacle apertures in use, but will slide out of the receptacle apertures for repositioning in other receptacle apertures as described herein for modifying the positions of the canopy.

The canopy is preferred to be formed of a textile, a textile blend, or woven or non-woven material. The ends of the canopy may be folded and sewn so as to form channel 24 at each end of the canopy through which the arcuate stanchions are inserted. The canopy slides on the arcuate stanchions and allows variation in the length of the canopy.

The base 2 is preferred to constructed of a rigid but lightweight material, such as molded plastic materials. The base is preferred to have a cutout or void 50 that is covered by pillow 14 when the sun shade so that a hard surface of the base is not under a substantial portion of the pillow. The base should not be present under at least one third (⅓) of the surface of the pillow that is opposite the back panel 12, with the pillow covering the base from the front edge to the back edge and the area from rib 30 to rib 32. Stanchion 26 can be inserted through apertures 52 in the pillow to hold the pillow in place while the canopy is in use, particularly where the sun shade is mounted at an angle, such as on a lounge chair.

What is claimed is:

1. A portable sun shade, comprising:

a base, the base comprising a first rib and a second rib that is positioned generally parallel to the first rib, each rib including upwardly extending humps at a front and rear end of the base with a reduced portion therebetween, at least one hump of each rib comprising a plurality of receptacle apertures;

a canopy having a first arcuate stanchion extending through the canopy and a second arcuate stanchion extending through the canopy, the canopy being elevated above the base and supported by the first arcuate stanchion and the second arcuate stanchion, wherein a first end of the first arcuate stanchion is held within a receptacle aperture of the first rib and a second end of the first arcuate stanchion is held within a receptacle aperture of the second rib, and a first end of the second arcuate stanchion is held within a receptacle aperture of the first rib and a second end of the first second stanchion is held within a receptacle aperture of the second rib; and wherein positioning of the arcuate stanchions within the receptacle apertures is user selectable so that shading or coverage of the user by the canopy may be varied.

2. The portable sun shade as described in claim 1, wherein each hump of each rib comprises a plurality of receptacle apertures.

3. The portable sun shade as described in claim 1, wherein a receptacle aperture of the first rib is formed at an angle of 20 to 40 degrees from vertical, and a corresponding receptacle aperture of the second rib is formed at an angle of 20 to 40 degrees from vertical.

4. The portable sun shade as described in claim 1, wherein the canopy is slidable along the first arcuate stanchion and the second arcuate stanchion, and the canopy of the sun shade is increasingly opened on a side there of as the canopy slides along the stanchions.

5. The portable sun shade as described in claim 1, wherein the canopy comprises a rear covering that extends from the second arcuate stanchion.

6. The portable sun shade as described in claim 1, wherein the first arcuate stanchion is positioned to extend the canopy outwardly and beyond the front of the base.

7. The portable sun shade as described in claim 1, wherein the canopy covers a first side of the sun shade, a second side of the sun shade, and a rear of the sun shade, and the sun shade comprises a front opening.

8. The portable sun shade as described in claim 1, further comprising a pillow that is positioned over the base and under the canopy.

9. The portable sun shade as described in claim 1, further comprising a pillow that is positioned over the base and under the canopy, wherein the first stanchion extends through an aperture formed in the pillow.

10. The portable sun shade as described in claim 1, wherein the base comprises a flat plane that is positioned between the first rib and the second rib.

11. The portable sun shade as described in claim 1, further comprising straps that are positioned through a void formed in the first rib and a void formed in the second rib.

12. The portable sun shade as described in claim 1, further comprising a mesh pocket formed on an interior of the canopy.

13. The portable sun shade as described in claim 1, wherein the first arcuate stanchion and the second arcuate stanchion are positioned in the receptacle apertures to not be parallel to each other.

* * * * *